United States Patent [19]

Arntzen

[11] 4,011,867

[45] Mar. 15, 1977

[54] DIVER'S PRESSURE CHAMBER SYSTEM

[75] Inventor: Arne-Johann Arntzen, Fyllingsdalen, Norway

[73] Assignee: Drägerwerk Aktiengesellschaft, Germany

[22] Filed: Sept. 30, 1975

[21] Appl. No.: 618,131

[30] Foreign Application Priority Data

Oct. 4, 1974 Germany ..... 2447362

[52] U.S. Cl. ..... 128/204; 61/69 R; 61/69 A; 98/1.5

[51] Int. Cl.[2] ..... B63C 11/32; A61M 16/02

[58] Field of Search ..... 61/69 R, 69 A, 81, 82; 128/204, 298; 98/1.5

[56] References Cited

UNITED STATES PATENTS

| | | | |
|---|---|---|---|
| 3,368,556 | 2/1968 | Jensen et al. | 61/81 X |
| 3,548,516 | 12/1970 | Lanphier et al. | 61/69 R X |

FOREIGN PATENTS OR APPLICATIONS

| | | | |
|---|---|---|---|
| 693,282 | 8/1965 | Italy | 128/204 |

*Primary Examiner*—Jacob Shapiro
*Attorney, Agent, or Firm*—McGlew and Tuttle

[57] ABSTRACT

A diver's pressure chamber system for use with a pressure chamber having a sealable access and a sealed transfer container for the diver, comprises a tubular projection which is formed around the access of the pressure chamber. In addition, a cylindrical lock space part is hermetically engageable and sealable with the tubular projection and defines, along with the tubular projection, the access, a lock space between the transfer container and the pressure chamber. In one form, the cylindrical lock space part is of substantially the same length as the transfer container and it is held to the projection formed around the access of the main pressure chamber, for example, by a rotatable bayonet-type sleeve catch. In another form, the main pressure chamber includes a lock space which is formed as a part of the projection extending outwardly from the pressure chamber and this lock space portion in turn includes a second projection forming a collar for a cylindrical lock space part which is engageable and hermetically sealable thereto.

8 Claims, 2 Drawing Figures

DIVER'S PRESSURE CHAMBER SYSTEM

FIELD AND BACKGROUND OF THE INVENTION

This invention relates in general to the construction of pressure chambers for divers and, in particular, to a new and useful lock system for transfer pressure chambers for such divers.

DESCRIPTION OF THE PRIOR ART

While coming to the surface from greater depths, the diver must wait certain periods of time during which he can again adapt to normal pressure. This may be done in pressure chambers for divers in which the pressure is controllable in accordance with physiological requirements. To make it possible, for example, to convey the divers who initially are transported in a small transfer pressure chamber to a place where they can get medical care, devices are known which permit the passing over of the diver into a stationary larger pressure chamber.

It is well known to couple a usually smaller diver's or transfer pressure chamber hermetically to a larger decompression chamber which is installed on the deck of a ship by means of closable connecting sockets which match with each other in order to lock the divers over under equal pressure in both chambers. In such devices, the connecting sockets comprise annular flanges with openings or slots which serve to bolt the two chambers together. However, the connection of the transfer chamber to the stationary decompression chamber is possible only if the two connecting sockets and their flanges match with each other. Thus, they must conform in size, shape, etc. to each other. The connection with bolts requires a certain time which might not be available if the medical treatment of the diver is urgently needed. It might happen that a life-saving aid cannot be ensured if the connecting sockets of the two chambers are not counterparts.

In another known design, the connection between the stationary chamber and a transfer chamber is established by attaching the transfer chamber to a suitable opening provided at the top of the stationary chamber. The connection is made hermetic by means of a sealing ring inserted in a receiving recess extending around the opening of the stationary chamber. The recess is provided with circumferentially arranged guides by which the transfer chamber is centered during the attachment so that it comes into a correct position relative to the recess and the sealing ring. The mechanical connection of the two chambers is ensured by screw bolts which are anchored to the transfer chamber and engaged in lugs of the recess. This connection of the two chambers is a disadvantageous construction inasmuch as the respective parts must match and thus belong to each other. If this is not the case, the same remarks apply as in respect to the previously mentioned prior art construction.

Even a connection of transfer chambers by means of slide catches or clamps with which the coupling may be effected in a shorter time requires fitting of the interconnecting parts. Consequently, the substantial drawback mentioned in the foregoing is inherent in these connecting means too.

Unfortunately, an international standardization of flange designs and dimensions, and thus of couplings, has not been successful. The alternative of providing corresponding intermediate rings as adapters for the various flange types is also unsatisfactory.

SUMMARY OF THE INVENTION

The present invention provides a lock system which makes it possible, independently of the design of the flange of the connection means, to receive any transfer pressure chamber in the lock space and then to lock the diver securely over the pressurized space of the stationary pressure chamber for the divers. In accordance with the invention, a lock space part is provided which is engageable by a coupling and hermetically connectable to a collar or projection of the lock space of the stationary pressure chamber for the divers. The lock space part is adapted to enclose any projecting portion of the transfer pressure chamber in which the diver may be positioned.

The particular advantage obtained by the invention is that any of the known transfer pressure chambers can be received in the lock space of the pressure chamber for the divers. With the invention, the lock space is enlarged by a lock space part which is coupled thereto. It is therefore no longer necessary to connect the transfer chamber to the pressure chamber for the divers by means of matching coupling parts. The particular design of the connecting parts of the stationary pressure chamber for the diver and of the transfer pressure chamber can no longer prevent a coupling. The locking is effected in any case. Should medical treatment be necessary, this is a life-saving advantage. In addition, it is no longer necessary, in principle, to provide any equipment on the transfer pressure chambers for a connection to the stationary pressure chamber for divers, be it by coupling or by flanges. In consequence, a substantially lighter construction may be provided for the transfer pressure chambers. For devices which have to be transported, this is an advantage which should not be overlooked.

According to a development of the invention, the lock space part is designed as a dome-shape cylinder. Its inside diameter and its inside clear width are greater than the outside dimensions of the known transfer pressure chambers. With such a design of the lock space part, it is assured that any transfer pressure chamber can be enclosed.

The connection with the stationary pressure chambers for divers is advantageously established by means of a bayonet catch or an equivalent joint. Such joints are developed to a high technical level. They permit a hermetical connection between the lock space part and the pressure chamber for divers without any difficulty. The connection is established rapidly and no additional closure means are necessary.

Another substantial advantage of the lock system, in accordance with the invention, is that it can be used for locking in and out in pressure chambers for divers which do not comprise a lock space. In such a case, the lock space part engageable by coupling is hermetically secured to the stationary pressure chamber for divers in which no lock space is provided and it is arranged directly over a door or access of the stationary pressure chamber. With such a construction, the lock space part itself, together with the access or door and the surrounding collar, form the lock space. In this case, the lock space part is designed so as to be able to receive the entire transfer pressure chamber.

Accordingly, it is an object of the invention to provide a diver's pressure chamber system for use with a pressure chamber having a sealable access and a sealed transfer container for the diver which comprises a tubular projection formed around the access and a cylindrical lock space part which is hermetically engageable and sealable with said tubular projection and defines with said tubular projection and said access a lock space between said transfer container and said pressure chamber.

A further object of the invention is to provide a construction which is usable with a stationary pressure chamber having a direct securing flange or lock space extending outwardly around the pressure chamber access door which comprises a lock space part which is of a length which either totally or partially covers a transfer chamber for the diver and which has a fitting which is hermetically engageable and sealable with the fitting directly around the access or door to the pressure chamber or around a lock space formed exteriorly of the pressure chamber.

Another object of the invention is to provide a diver's pressure chamber system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
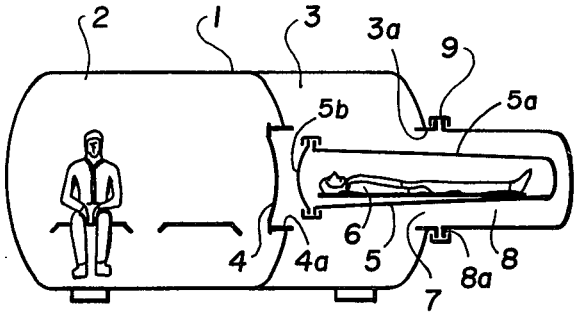
FIG. 1 is a schematic sectional view of a stationary pressure chamber for divers having a lock space and a lock space part coupled thereto, constructed in accordance with the invention.

Referring to the drawing in particular, the invention embodied therein in FIG. 1, comprises the usual stationary pressure chamber for divers 1, which is subdivided into a main chamber 2 and a lock space chamber 3. Main chamber 2 is the waiting room for the divers. It is provided with an access collar 4*a* which is sealed by an access door 4. Lock space 3 is also provided with a collar 3*a* which is usually aligned with the access door 4. In the lock space 3, the pressure is brought up to the pressure level of the transfer chamber or the ambience for locking the diver either in or out. Lock space 3 and main chamber 2 communicate with each other through door 4.

A usual transfer pressure chamber 5 is indicated with a diver 6 therein who is to be locked in, and this transfer pressure chamber 5 is introduced into the lock space 3 through the opening 7. The transfer pressure chamber 5 is formed of a cylindrical part 5*a* closed at one end and having an opposite end with a sealing cover 5*b* which may be removed to transfer the diver after after it is positioned in the lock space 3 and ot has been brought to the desired transfer pressure.

In accordance with the invention, there is provided a cylindrical lock space part 8 which surrounds the outwardly projecting portion of the transfer pressure chamber 5. The lock space part is constructed with a flange fitting 8a which is made to permit easy coupling engagement with flange 3a with the aid of a bayonet catch 9. Upon connecting lock space part 8 by coupling, the pressure is equalized in lock space 3 with pressure chamber 2, so that the diver can move out of the transfer chamber 5 and into main pressure chamber 2.

Figure 2:
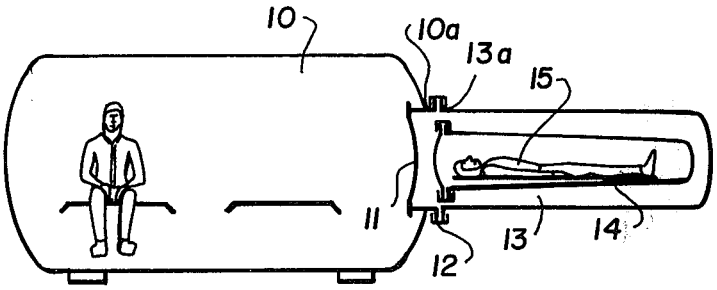
FIG. 2 is a view similar to FIG. 1 of another embodiment of the invention.

In the embodiment of the invention shown in FIG. 2, there is a stationary pressure chamber for divers 10 which has no additional lock space. Stationary pressure chamber 10 is provided with an opening flange 10*a* which is closed by an access or door 11. Flange 10*a* is also provided with a coupling closure 12 which is engageable with flange 10*a* and a flange 13*a* of a lock space part 13. In this embodiment, lock space part 13 is in the form of a dome-shape cylinder which is sized larged enough to receive substantially the entire length of the transfer pressure chamber 14 accommodating the diver 15. With chamber 14 still enclosed, it is hermetically connected to flange 10*a* by coupling part 12. After the pressure in the thus formed lock space 13 is equalized with lock space 10, the diver may be passed into chamber 10 in the usual manner.

The conventional equipment, such as rails, lifting devices, etc., which are necessary for moving and aligning the transfer pressure chambers 5 and 14 and the lock space parts 8 and 13 are not shown. Such parts, however, may be of conventional form and are not part of the present invention.

While specific embodiments of the invention have been shown and described in detail to illustrate the application of the principles of the invention, it will be understood that the invention may be embodied otherwise without departing from such principles.

What is claimed is:

1. A diver's pressure chamber system for use with a fixed pressure chamber having a sealable access and using a transportable sealed diver's transfer container for the diver, comprising, a tubular projection formed around the access, a separate portable cylindrical lock space part hermetically engageable and sealable with said tubular projection and defining with said tubular projection and said access a pressurizable lock space which may be brought to a desired transfer pressure, and a sealed diver's transfer container positionable in said lock space having a removable sealing cover which may be removed when the lock space is brought to a pressure comparable to the transfer container and to the pressure chamber.

2. A diver's pressure chamber system, according to claim 1, wherein said lock space part comprises a domeshape cylinder.

3. A diver's pressure chamber system, according to claim 1, wherein said lock space part has an inside diameter and an inside clear width which are greater than the outside dimensions of the known transfer pressure chambers.

4. A diver's pressure chamber system, according to claim 1, including a coupling carried on said tubular projection and engageable with said lock space part and forming a bayonet catch for hermetically interengaging said lock space part with said tubular projection.

5. A diver's pressure chamber system, according to claim 1, including a lock space member secured to the stationary pressure chamber and having said tubular projection, said lock space part having a flange engageable with said tubular projection and a coupling member engageable with the flange of said lock space part and said tubular projection for hermetically sealing said lock space part to said lock space member.

6. A diver's pressure chamber system according to claim 1, wherein said tubular projection is formed directly around said access, said lock space part being flanged directly to said tubular projection.

7. A diver's pressure chamber system comprising a fixed cylindrical member having a closed end and an opposite end with an access opening and an access door closing said opening, a seal projection extending outwardly from said access door, a separate portable lock space part comprising a cylindrical member having a closed outer end and an inner end with an inner flange engageable with the projection around said access door, coupling means interengaging said lock space part with said access door projection and sealing said lock space part thereto, and a sealed pressurizable diver's transfer container/positionable in said lock space and having a removable transfer container sealing cover which may be removed when the lock space is brought to a pressure comparable to the transfer container pressure and to the pressure chamber pressure.

8. A diver's pressure chamber system, according to claim 7, wherein said stationary pressure chamber includes an additional lock space portion extending outwardly therefrom beyond said access door and having a separate access opening forming said projection, said projection being coupled to said lock space part.

* * * * *